US012686527B2

(12) United States Patent
Krautkrämer

(10) Patent No.: US 12,686,527 B2
(45) Date of Patent: Jul. 21, 2026

(54) TETHERED CLOSURE DEVICE WITH STABILISED CONNECTING ELEMENT

(71) Applicant: BERICAP Holding GmbH, Budenheim (DE)

(72) Inventor: Alexander Krautkrämer, Budenheim (DE)

(73) Assignee: BERICAP Holding GmbH, Budenheim (DE)

( * ) Notice: Subject to any disclaimer, the term of this patent is extended or adjusted under 35 U.S.C. 154(b) by 0 days.

(21) Appl. No.: 18/849,419

(22) PCT Filed: Apr. 18, 2023

(86) PCT No.: PCT/EP2023/059998
§ 371 (c)(1),
(2) Date: Sep. 20, 2024

(87) PCT Pub. No.: WO2023/208650
PCT Pub. Date: Nov. 2, 2023

(65) Prior Publication Data

US 2025/0187786 A1 Jun. 12, 2025

(30) Foreign Application Priority Data

Apr. 26, 2022 (DE) ..... 10 2022 110 068.5
Apr. 26, 2022 (DE) ..... 10 2022 110 069.3

(51) Int. Cl.
*B65D 5/74* (2006.01)
*B65D 55/16* (2006.01)

(52) U.S. Cl.
CPC ..... *B65D 5/747* (2013.01); *B65D 55/16* (2013.01)

(58) Field of Classification Search
CPC ..... B65D 2301/10; B65D 2571/00172; B65D 2571/00314; B65D 2571/00543;
(Continued)

(56) References Cited

U.S. PATENT DOCUMENTS

2021/0229873 A1* 7/2021 Berroa García ... B65D 41/3447

FOREIGN PATENT DOCUMENTS

DE 202019106993 U1 * 1/2020 ..... B65D 55/16
DE 20 2021 103 289 U 7/2021
(Continued)

OTHER PUBLICATIONS

International Search Report / Written Opinion for PCT/EP2023/059998, dated Aug. 11, 2023.
(Continued)

*Primary Examiner* — Anthony D Stashick
*Assistant Examiner* — Marcos Javier Rodriguez Molina
(74) *Attorney, Agent, or Firm* — Maxwell J. Petersen; FisherBroyles, LLP

(57) ABSTRACT

A closure device for a container, particularly a carton package, is provided. The closure device includes a basic member having a pouring channel extending along a closure axis with an inlet opening and a pouring opening, and a closure cap having a cap cover and a cap skirt adjoining the cap cover circumferentially and extending axially. The closure cap and the basic member are configured such that the closure cap closes the pouring opening in a closed position and releases it in an open position. The closure device includes an anchor ring and a connecting element that connects the anchor ring to the closure cap in a tension-proof manner. The anchor ring engages the basic member in the closed position and in the open position such that the closure cap is tethered to the basic member with the connecting element and the anchor ring in the open position.

17 Claims, 8 Drawing Sheets

(58) Field of Classification Search
CPC ..... B65D 5/747; B65D 51/22; B65D 51/222; B65D 51/226; B65D 51/2835; B65D 55/16; B65D 83/0841; B65D 1/00; B65D 1/0207; B65D 1/023; B65D 1/0246; B65D 1/0261; B65D 1/0292; B65D 1/06; B65D 1/24; B65D 1/34; B65D 11/02; B65D 11/10; B65D 11/1833; B65D 11/1846; B65D 11/1873; B65D 11/20; B65D 11/22; B65D 15/08; B65D 17/02; B65D 17/12; B65D 17/28; B65D 17/353; B65D 17/4011; B65D 17/4012; B65D 17/42; B65D 17/44; B65D 17/462; B65D 17/506; B65D 19/02; B65D 19/18; B65D 21/0204; B65D 21/0217; B65D 21/0219; B65D 21/022; B65D 21/0224; B65D 21/0227; B65D 21/0228; B65D 21/0233; B65D 21/086; B65D 2203/00; B65D 2203/02; B65D 2203/10; B65D 2203/12; B65D 2205/00; B65D 2205/02; B65D 2207/00; B65D 2215/00; B65D 2215/02; B65D 2215/04; B65D 2215/06; B65D 2231/02; B65D 2231/022; B65D 2251/0012; B65D 2251/0015; B65D 2251/0021; B65D 2251/0025; B65D 2251/0028; B65D 2251/0031; B65D 2251/0056; B65D 2251/0075; B65D 2251/0087; B65D 2251/009; B65D 2251/0093; B65D 2251/0096; B65D 2251/01; B65D 2251/02; B65D 2251/023; B65D 2251/04; B65D 2251/10; B65D 2251/1008; B65D 2251/1016; B65D 2251/1025; B65D 2251/1033; B65D 2251/105; B65D 2251/1058; B65D 2251/1066; B65D 2251/20; B65D 2255/20; B65D 23/003; B65D 23/02; B65D 23/102; B65D 23/106; B65D 23/108; B65D 23/12; B65D 2313/04; B65D 2401/00; B65D 2401/05; B65D 2401/15; B65D 2401/20; B65D 2401/25; B65D 2401/30; B65D 2401/35; B65D 2401/40; B65D 2401/50; B65D 2401/55; B65D 2401/60; B65D 25/005; B65D 25/04; B65D 25/10; B65D 25/20; B65D 25/22; B65D 25/28; B65D 25/2858; B65D 25/2882; B65D 25/36; B65D 25/40; B65D 25/46; B65D 25/48; B65D 25/52; B65D 25/54; B65D 25/56; B65D 2501/0081; B65D 2517/0007; B65D 2517/0013; B65D 2517/0016; B65D 2517/0022; B65D 2517/0041; B65D 2517/0049; B65D 2517/0052; B65D 2517/0071; B65D 2517/0074; B65D 2517/0083; B65D 2517/0086; B65D 2517/0089; B65D 2517/0098; B65D 2519/00034; B65D 2519/00069; B65D 2519/00174; B65D 2519/00208; B65D 2519/00288; B65D 2519/00333; B65D 2519/00407; B65D 2519/00422; B65D 2519/00502; B65D 2519/00587; B65D 2519/00646; B65D 2519/00805; B65D 2519/00815; B65D 2519/0086; B65D 2519/009; B65D 2519/0096; B65D 2519/00975; B65D 2525/283; B65D 2539/003; B65D 2539/006; B65D 2543/00046; B65D 2543/00083; B65D 2543/00092; B65D 2543/00101; B65D 2543/00148; B65D 2543/00194; B65D 2543/00222; B65D 2543/00231; B65D 2543/0024; B65D 2543/00268; B65D 2543/00296; B65D 2543/00314; B65D 2543/00351; B65D 2543/00361; B65D 2543/00379; B65D 2543/00388; B65D 2543/00425; B65D 2543/00435; B65D 2543/00462; B65D 2543/00509; B65D 2543/00518; B65D 2543/00527; B65D 2543/00537; B65D 2543/00546; B65D 2543/00555; B65D 2543/00564; B65D 2543/00629; B65D 2543/00638; B65D 2543/00648; B65D 2543/00685; B65D 2543/00694; B65D 2543/00722; B65D 2543/00731; B65D 2543/0074; B65D 2543/00759; B65D 2543/00796; B65D 2543/00805; B65D 2543/00814; B65D 2543/00842; B65D 2543/00944; B65D 2543/00962; B65D 2543/00972; B65D 2543/00981; B65D 2547/06; B65D 2547/066; B65D 2563/107; B65D 2563/108; B65D 2565/384; B65D 2571/00055; B65D 2571/00141; B65D 2571/0016; B65D 2571/00277; B65D 2571/0029; B65D 2571/00308; B65D 2571/00388; B65D 2571/00444; B65D 2571/00487; B65D 2571/0066; B65D 2571/00753; B65D 2571/00759; B65D 2571/00783; B65D 2575/3227; B65D 2575/586; B65D 31/14; B65D 33/00; B65D 35/38; B65D 35/42; B65D 35/44; B65D 35/46; B65D 39/00; B65D 39/0005; B65D 39/0023; B65D 39/0052; B65D 39/0076; B65D 39/08; B65D 39/084; B65D 41/023; B65D 41/04; B65D 41/0414; B65D 41/0421; B65D 41/0428; B65D 41/045; B65D 41/0471; B65D 41/0478; B65D 41/0485; B65D 41/0492; B65D 41/18; B65D 41/185; B65D 41/20; B65D 41/26; B65D 41/32; B65D 41/325; B65D 41/34; B65D 41/3404; B65D 41/3409; B65D 41/3423; B65D 41/3428; B65D 41/3438; B65D 41/3442; B65D 41/3447; B65D 41/3457; B65D 41/3466; B65D 41/348; B65D 41/385; B65D 41/46; B65D 41/465; B65D 41/48; B65D 41/485; B65D 41/50; B65D 43/02; B65D 43/0202; B65D 43/0204; B65D 43/0206; B65D 43/0212; B65D 43/0216; B65D 43/0218; B65D 43/022; B65D 43/0222; B65D 43/0225; B65D 43/0231; B65D 43/0237; B65D 43/0262; B65D 43/0283; B65D 43/16; B65D 43/161; B65D 43/162; B65D 43/163; B65D 43/164; B65D 43/166; B65D 43/167; B65D 43/169; B65D 43/18; B65D 43/22; B65D 43/24; B65D 43/267; B65D 45/02; B65D 45/16; B65D 45/20; B65D 45/24; B65D 45/32; B65D 45/322; B65D 45/345; B65D 47/043; B65D 47/06; B65D 47/061; B65D 47/063; B65D 47/065; B65D 47/066; B65D 47/08; B65D 47/0804; B65D 47/0809; B65D 47/0814; B65D 47/0823; B65D 47/0828; B65D 47/0833; B65D 47/0838; B65D 47/0842; B65D 47/0847; B65D 47/0852; B65D 47/0857; B65D 47/0861; B65D 47/0876; B65D 47/088; B65D 47/0885; B65D 47/10; B65D 47/103; B65D 47/12; B65D 47/121; B65D 47/122; B65D 47/123; B65D 47/127; B65D 47/128; B65D 47/14; B65D 47/141; B65D 47/142; B65D 47/143; B65D 47/148; B65D 47/18; B65D 47/20; B65D 47/2006; B65D 47/2018; B65D 47/2031; B65D 47/2037; B65D 47/2081; B65D 47/24; B65D 47/241; B65D 47/242; B65D 47/243; B65D 47/244; B65D 47/246; B65D 47/249; B65D 47/26; B65D 47/261; B65D 47/265; B65D 47/286; B65D 47/32; B65D 47/36; B65D 47/38; B65D 47/42; B65D 49/00; B65D 5/029; B65D 5/067; B65D 5/2033; B65D 5/241; B65D 5/3628; B65D 5/40; B65D 5/42; B65D 5/4279; B65D 5/4604; B65D 5/4608; B65D 5/46104; B65D 5/46136; B65D 5/5425; B65D 5/726; B65D 5/74; B65D 5/746; B65D 5/748; B65D 5/749; B65D 50/041; B65D 50/045; B65D 50/046; B65D 50/061; B65D 50/062; B65D 50/067; B65D 51/002; B65D 51/02; B65D 51/14; B65D 51/145; B65D 51/16; B65D 51/1611; B65D 51/1616; B65D 51/1622; B65D 51/1633; B65D 51/1644; B65D 51/1661; B65D 51/1672; B65D 51/1677; B65D 51/1683; B65D 51/1688; B65D 51/18; B65D 51/185; B65D 51/20; B65D 51/228; B65D 51/24; B65D 51/242; B65D 51/243; B65D 51/244; B65D 51/245; B65D 51/246; B65D 51/247; B65D 51/248; B65D 51/249; B65D 51/26; B65D 51/28; B65D 51/2807; B65D 51/2814; B65D 51/2871; B65D 51/2878; B65D 51/2892; B65D 51/30; B65D 53/00; B65D 53/02; B65D 53/04; B65D 53/08; B65D 53/10; B65D 55/00; B65D 55/02; B65D 55/022; B65D 55/024; B65D 55/026; B65D 55/06; B65D 55/0818; B65D 55/0863; B65D 55/0872; B65D 55/14; B65D 55/165; B65D 59/04; B65D 63/00; B65D 63/06; B65D 63/08; B65D 63/1027; B65D 63/1072; B65D 63/16; B65D 63/18; B65D 65/38; B65D 65/40; B65D 65/463; B65D 67/00; B65D 71/00; B65D 71/0022; B65D 71/0096; B65D 71/02; B65D 71/16; B65D 71/502; B65D 71/70; B65D 73/0064; B65D 75/327; B65D 75/50; B65D 75/54; B65D 75/58; B65D 75/5838; B65D 75/585; B65D 75/5855; B65D 75/5861; B65D 75/5872; B65D 75/5877; B65D 77/003; B65D 77/042; B65D 77/0453; B65D 77/06; B65D 77/067; B65D 77/2028; B65D 77/2032; B65D 77/225; B65D 77/24; B65D 77/283; B65D 79/0087; B65D 79/02; B65D 81/03; B65D 81/052; B65D 81/107; B65D 81/127; B65D 81/18; B65D 81/2015; B65D 81/2038; B65D 81/2076; B65D 81/24; B65D 81/245; B65D 81/26; B65D 81/264; B65D 81/266; B65D 81/267; B65D 81/268; B65D 81/28; B65D 81/30; B65D 81/3205; B65D 81/3211; B65D 81/3261; B65D 81/3288; B65D 81/3484; B65D 81/365; B65D 81/366; B65D 81/368; B65D 81/38; B65D 81/3823; B65D 81/3825; B65D 81/3876; B65D 81/3879; B65D 83/0409; B65D 83/0463; B65D 83/0472; B65D 83/06; B65D 83/0805; B65D 83/164; B65D 83/18

USPC ..... 206/221, 1.5, 210, 216, 217, 218, 219, 206/222, 233, 242, 261, 265, 277, 278, 206/284, 315.1, 315.5, 319, 320, 361, 206/362, 363, 364, 365, 366, 37, 370, 38, 206/386, 425, 430, 432, 438, 443, 446, 206/448, 45.2, 457, 459.1, 461, 499, 5, 206/503, 508, 509, 518, 521, 521.2, 522, 206/523, 524.6, 528, 531, 532, 534, 535, 206/538, 545, 557, 564, 565, 570, 583, 206/594, 597, 701, 710, 711, 714, 775, 206/807, 815; 215/11.1, 11.3, 11.6, 206, 215/209, 213, 216, 217, 218, 221, 223, 215/224, 225, 228, 229, 230, 235, 237, 215/24, 243, 245, 247, 248, 250, 252, 215/253, 255, 256, 258, 269, 272, 273, 215/274, 277, 278, 295, 304, 305, 306, 215/307, 308, 309, 311, 317, 329, 341, 215/344, 345, 352, 355, 364, 382, 387, 215/388, 390, 391, 399, 43, 6, 901, 215/DIG. 1, DIG. 3, DIG. 6, DIG. 8; 220/203.06, 211, 212, 229, 23.2, 23.6, 220/23.8, 231, 232, 239, 253, 254.1, 220/254.2, 254.3, 254.4, 254.5, 254.6, 220/254.7, 254.8, 254.9, 255, 255.1, 220/256.1, 257.1, 258.1, 258.2, 258.3, 220/258.5, 259.1, 259.2, 259.3, 260, 262, 220/263, 265, 266, 267, 268, 269, 270, 220/273, 276, 277, 278, 281, 285, 288, 220/291, 3.2, 3.3, 315, 321, 324, 326, 220/345.1, 345.2, 345.4, 345.5, 359.1, 220/361, 366.1, 367.1, 371, 372, 373, 220/375, 376, 378, 379, 4.02, 495.03, 220/506, 521, 522, 524, 528, 529, 531, 220/533, 536, 542, 545, 560, 574.1, 220/592.02, 592.2, 592.26, 661, 666, 703, 220/705, 706, 707, 708, 710, 711, 712, 220/713, 714, 715, 717, 735, 739, 740, 220/745, 754, 757, 789, 8, 801, 810, 815, 220/816, 819, 826, 832, 834, 835, 837, 220/839, 840, 847, 849, 86.2, 88.2, 903, 220/906, 908, 909, DIG. 33

See application file for complete search history.

(56) References Cited

FOREIGN PATENT DOCUMENTS

| | | | | |
|---|---|---|---|---|
| DE | 10 2021 117 931 A1 | | 1/2022 | |
| EP | 3842358 A1 | | 6/2021 | |
| EP | 3854717 A1 | * | 7/2021 | ..... B65D 55/16 |
| EP | 3882173 A1 | * | 9/2021 | ..... B65D 41/3428 |
| ES | 1232089 U | * | 7/2019 | ..... B65D 41/3447 |

(56) References Cited

FOREIGN PATENT DOCUMENTS

| | | | | | |
|---|---|---|---|---|---|
| ES | 2845227 | A1 | * | 7/2021 | ..... B65D 41/385 |
| WO | 2019 238 988 | A1 | | 12/2019 | |
| WO | 2021 242 468 | A1 | | 2/2021 | |
| WO | WO-2021165131 | A1 | * | 8/2021 | ..... B65D 5/748 |
| WO | WO-2022008758 | A1 | * | 1/2022 | ..... B65D 55/16 |
| WO | 2022 048 934 | A1 | | 3/2022 | |
| WO | 2022 136 054 | A1 | | 6/2022 | |

OTHER PUBLICATIONS

European Search Report for EP24153212.6, dated Feb. 19, 2024.
German Search Report for DE 10 2022 110 069.3, dated May 10, 2022.

* cited by examiner

TETHERED CLOSURE DEVICE WITH STABILISED CONNECTING ELEMENT

RELATED APPLICATIONS

This patent application is a 35 U.S.C. § 371 National Stage entry of PCT/EP2023/059998, filed Apr. 18, 2023, which in turn claims priority based on German Patent Applications DE 10 2022 110 069.3, filed Apr. 26, 2022, and DE 10 2022 110 068.5, filed Apr. 26, 2022, the disclosures of which are incorporated herein by reference.

FIELD OF THE INVENTION

The present invention relates to a closure device for a container, in particular for a carton package, wherein the closure device comprises a basic member, wherein the basic member has a pouring channel extending along a closure axis with an inlet opening and a pouring opening, wherein the closure device comprises a closure cap, wherein the closure cap has a cap cover and a cap skirt adjoining the cap cover circumferentially and extending axially, wherein the closure cap and the basic member are configured such that the closure cap closes the pouring opening in a closed position of the closure cap and releases it in an open position of the closure cap, wherein the closure device comprises an anchor ring and a connecting element, wherein the connecting element connects the anchor ring to the closure cap in a tension-proof manner, wherein the anchor ring is in engagement with the basic member both in the closed position of the closure cap and in the open position of the closure cap in such a way that the closure cap is also tethered to the basic member with the connecting element and the anchor ring in the open position of the closure cap.

BACKGROUND OF THE INVENTION

It has been shown that closure devices tethered in this way cause operating problems in everyday use, as the closure cap can often be moved too easily relative to the basic member after the closure has been opened for the first time, making it difficult to reclose. This is because the user of the closure device must position the closure cap precisely in relation to the pouring opening in order to enable reclosure. Slight relative displacements of the closure cap with respect to the pouring opening block easy reclosure.

Against this background, it is a problem of the present invention to provide a closure device with which the aforementioned problems are eliminated or at least reduced.

SUMMARY OF THE INVENTION

This problem is solved by a closure device for a container, in particular for a carton package, the closure device comprising a base element, the base element having a pouring channel extending along a closure axis with an inlet opening and a pouring opening, the closure device comprising a closure cap, wherein the closure cap has a cap cover and a cap skirt adjoining the cap cover circumferentially and extending axially, wherein the closure cap and the base element are configured in such a way that the closure cap closes the pouring opening in a closed position of the closure cap and releases it in an open position of the closure cap, wherein the closure device comprises an anchor ring and a connecting element, wherein the connecting element connects the anchor ring to the closure cap in a tension-proof manner, wherein the anchor ring is in engagement with the basic member both in the closed position of the closure cap and in the open position of the closure cap in such a way that the closure cap is also tethered to the basic member with the connecting element and the anchor ring in the open position of the closure cap, wherein the connecting element has a connecting web extending between a first end portion and a second end portion, wherein the first end portion of the connecting web is connected to the anchor ring, wherein the second end portion of the connecting web is connected to the anchor ring, wherein the closure device is configured such that the connecting web is axially movable relative to the anchor ring, wherein the connecting element comprises a hinge element in addition to the connecting web, wherein the hinge element connects the connecting web to the cap skirt and is arranged between the connecting web and the cap skirt, wherein the hinge element defines a pivot axis, wherein the hinge element is configured such that the closure cap is pivotably mounted relative to the connecting web about the pivot axis.

For the purposes of the present invention, a connecting web which is axially movable relative to the anchor ring is to be understood in particular as a connecting web which moves away relative to the anchor ring during an opening movement of the closure cap in the axial direction or approaches the anchor ring during a closing movement of the closure cap in the axial direction. An opening movement in this sense can in particular be an opening rotational movement of the closure cap about the closure axis, a closing movement in this sense can in particular be a closing rotational movement of the closure cap about the closure axis.

By combining a connecting web, which can be moved axially relative to the anchor ring, with an additional hinge element in accordance with the invention, the connecting element only has a smaller number of degrees of freedom of movement. In particular, this makes it possible for the connecting web to maintain its axial alignment and thus not be twisted, even if the closure cap is pivoted by means of the hinge element in order to bring it into the open position.

In one embodiment of the closure device according to the invention, the hinge element is configured and arranged such that the pivot axis is arranged at an axial distance from the connecting web. This is particularly the case if the hinge element has two symmetrically configured wings that are spaced apart in the circumferential direction. The two wings each connect the connecting web to the cap skirt so that the pivot axis is arranged between the axial position in which the wings are connected to the connecting web and the axial position in which the wings are connected to the cap skirt. This spatial separation of the pivot axis and the connecting web results in a better, i.e. particularly stable, locking of the connecting web relative to the basic member.

In one embodiment of the closure device according to the invention, the connecting web and the hinge element are configured in such a way that the connecting web has essentially no torsion when the closure cap is in the open position. This leads to a higher positional stability of the closure cap in the open position and thus to a reduction in the risk of operating errors when reclosing the closure cap.

In one embodiment of the closure device according to the invention, the connecting web and the anchor ring are separated from each other in the axial direction by a gap extending in the circumferential direction, the gap preferably being bridged by at least one easily tearable bridge before the closure device is opened for the first time. This enables axial movement of the connecting web relative to the anchor ring in a particularly simple manner.

In one embodiment of the closure device according to the invention, the connecting element has a support element, wherein the support element is configured and arranged such that it is in engagement with an outer surface of the basic member and locks the connecting web when the closure cap performs an opening pivoting movement about the pivot axis in order to bring the closure cap into the open position, wherein the support element is preferably arranged on the connecting web. The support element supports the connecting web and thus also the closure cap in the open position of the closure cap relative to the basic member. The connecting web therefore remains in its axially lifted position from the anchor ring as long as no non-everyday forces act on it. This also facilitates the reclosing movement.

In one embodiment of the closure device according to the invention, the support element can be mounted on a radially protruding support surface of the basic member.

In one embodiment of the closure device according to the invention, the hinge element is a film hinge. These are associated with a particularly low material cost and are particularly suitable for combination with an additional connecting web, which itself does not fulfil a hinge function.

In one embodiment of the closure device according to the invention, the closure cap has a first guiding means, wherein the basic member has a second guiding means, wherein the first guiding means and the second guiding means can be disengaged in order to open the closure device, wherein the first guiding means and the second guiding means can be brought into engagement with one another in order to close the closure device, wherein the first and the second guiding means are configured in such a way that an opening rotational movement of the closure cap in the circumferential direction relative to the basic member is necessary for disengagement of the first and second guiding means.

In one embodiment of the closure device according to the invention, the connecting element has a guide element, wherein the guide element can be brought into engagement with the second guiding means in such a way that the opening rotational movement of the closure cap causes a movement of the connecting web with an axial movement component relative to the anchor ring in a direction pointing from the inlet opening to the pouring opening.

In one embodiment of the closure device according to the invention, the guide element is the support element. Due to this dual function performed by the guide element or support element, the advantages according to the invention are realised in a particularly simple and material-saving manner.

In one embodiment of the closure device according to the invention, the first guiding means comprises an internal thread, wherein the second guiding means comprises an external thread, wherein the guide element comprises an internal thread segment. Particularly in the case of closures that have a thread with a thread pitch greater than zero, the division of the connecting web and hinge element into two parts is very advantageous, as the thread can be used to cause the connecting web and anchor ring to move apart axially by the opening rotational movement. This contributes to the stability of the closure as perceived by the user if the connecting web itself does not fulfil a hinge function.

In one embodiment of the closure device according to the invention, the guide element is arranged on an inner surface of the connecting web facing the closure axis when the closure cap is in the closed position. The direct attachment of the guide element, which is optionally also configured as a support element, to the connecting web helps to ensure that the connecting web maintains its alignment with respect to the basic member even when the closure cap is pivoted into the open position.

In one embodiment of the closure device according to the invention, the guide element and the hinge element are configured and arranged in such a way that the guide element is at a shorter distance from the inlet opening than the pivot axis. In other words, the guide element is arranged below the pivot axis. In particular, the guide element is then also arranged below the hinge element.

In one embodiment of the closure device according to the invention, the connecting web moves away from the anchor ring in the axial direction at least locally by at least 0.3 mm, preferably at least 0.5 mm, during a fully executed opening rotational movement of the closure cap.

In one embodiment of the closure device according to the invention, the guide element comprises two axially offset internal thread segments, wherein the two axially offset internal thread segments are preferably arranged axially one above the other at least in sections. In a preferred embodiment, the two internal thread segments are configured and arranged in such a way that they enclose the second guiding means on both sides in the axial direction when the closure cap is in the open position. This enables a positive fit in the axial direction between the guide element and the second guiding means arranged on the basic member, e.g. an external thread. Thus, it is advantageously hardly possible for a user of the closure device to cause an unintentional axial displacement of the connecting web when the closure cap is in the open position. In particular, it is also made more difficult for the user to unintentionally cause an axial displacement of the connecting web towards the anchor ring without performing a rotational closing movement of the closure cap.

In one embodiment of the closure device according to the invention, a first of the two axially offset internal thread segments has a first profile depth x and a second of the two axially offset internal thread segments has a second profile depth y, wherein the first profile depth x is equal to the second profile depth y. This is particularly useful if the two internal thread segments are also used as support means within the meaning of the present invention. This is because the greater the profile depth of the support means, the stronger the supporting effect of such a guiding means configured as a support means. If both guiding means have the same profile depth and thus a comparable supporting effect, the overall supporting effect is further enhanced.

In one embodiment of the closure device according to the invention, a first of the two axially offset internal thread segments has a first profile depth x and a second of the two axially offset internal thread segments has a second profile depth y, wherein the first profile depth x is greater than the second profile depth y. This is particularly advantageous if the supporting effect of a single internal thread segment is already sufficiently strong and the second internal thread segment is used primarily for improved guidance of the closure cap during the opening and rotating movement. In this case, material can be saved by forming an internal thread segment with a comparatively shallower profile depth.

In one embodiment of the closure device according to the invention, the first internal thread segment has a smaller axial distance to the pivot axis than the second internal thread segment.

In one embodiment of the closure device according to the invention, the guide element comprises an internal thread segment with at least one thread run-out. A thread run-out is to be understood as a section of the internal thread segment within which the axial extension of the internal thread segment is continuously reduced when viewed in a circumferential direction. This results in a largely trouble-free user experience when performing an opening or closing rotational movement. The user does not feel any sudden mechanical resistance when performing the opening or closing rotational movement.

In one embodiment of the closure device according to the invention, the guide element extends in the circumferential direction over an angular range of 5 to 45 degrees. It has been shown that an extension within these limits is sufficient to ensure the functionality of the guide element, in particular to enable the guide element to be used as a support element.

In one embodiment of the closure device according to the invention, the guide element extends in the circumferential direction over an angular range of 10 to 35 degrees. It has been shown that an extension within these limits is well suited to ensure the functionality of the guide element.

In one embodiment of the closure device according to the invention, the guide element extends in the circumferential direction over an angular range of 15 to 25 degrees. It has been shown that an extension within these limits is particularly suitable for ensuring the functionality of the guide element.

In one embodiment of the closure device according to the invention, the external thread of the basic member has a thread pitch a, wherein the internal thread segment of the guide element has a thread pitch b, wherein the thread pitch a and the thread pitch b have essentially the same amount. This also means that the user does not experience any disturbing sudden mechanical resistance when opening or closing the closure cap.

In one embodiment of the closure device according to the invention, the closure device comprises a cutting device with a cutting element arranged at least in sections within the pouring channel, wherein the closure cap comprises at least one first entraining web with an inner surface directed towards the closure axis and an outer surface directed away from the closure axis, wherein the first entraining web and the cutting device are configured and arranged such that an initial rotation of the closure cap in a direction of opening rotation causes a movement of the cutting element from an initial position of the cutting element in a direction pointing from the pouring opening to the inlet opening, so that the cutting element can be moved at least in sections through the inlet opening, wherein the closure axis is the axis of rotation of the direction of opening rotation. The presence of a cutting device increases the requirements for the closure device. In particular, it must be ensured that the closure cap can be rotated through a certain angle of rotation so that a sufficiently configured cutting movement of the cutting elements can be achieved. The design of the connecting element according to the invention is particularly advantageous in this respect, as it enables a rotation movement that is easy for the user to handle, even through larger rotation angles, e.g. 360 degrees, despite the connection via the anchor ring.

In one embodiment of the closure device according to the invention, the first entraining web is connected to the cap cover and extends axially in the direction from the cap cover to the inlet opening when the closure cap is in the closed position.

In one embodiment of the closure device according to the invention, the outer surface of the entraining web is temporarily in contact with a spout edge section of the basic member when a pivoting movement of the closure cap is performed. Temporary contact between the entraining web and the spout edge section when executing the pivoting movement of the closure is to be understood as contact that is only limited in time in relation to a complete time sequence of the pivoting movement of the closure.

In one embodiment of the closure device according to the invention, the outer surface of the entraining web has a ramp section, wherein the entraining web, the spout edge section and the connecting element are configured in such a way that during the pivoting movement of the closure the spout edge section is temporarily in continuous sliding friction contact with the ramp section of the entraining web, wherein the ramp section is configured such that the surface normal of the ramp section deviates from a vector extending purely radially to the closure cap axis, wherein the closure cap axis is defined by the cylinder axis of the cap skirt.

In one embodiment of the closure device according to the invention, the closure device is configured such that, during the pivoting movement of the closure, a first contact region of the entraining web is in contact with the spout edge section before a second contact region of the entraining web, wherein the first contact region is arranged axially spaced from the second contact region, wherein preferably the second contact region is at a shorter distance from the cap cover than the first contact region, wherein particularly preferably the second contact region is at a shorter distance from the cap skirt than the first contact region.

In one embodiment of the closure device according to the invention, the first contact region is arranged at a distance from the second contact region in the circumferential direction.

In one embodiment of the closure device according to the invention, the closure device is configured in such a way that the entraining web supports the closure cap on the spout edge section during the execution of the pivoting movement of the closure cap in such a way that the pivoting axis moves at least temporarily and at least in sections axially in the direction of the pouring opening during the execution of the pivoting movement of the closure cap.

In one embodiment of the closure device according to the invention, the closure device is configured in such a way that the outer surface of the entraining web supports the closure cap on the spout edge section during the execution of the pivoting movement of the closure cap in such a way that the execution of the pivoting movement of the closure cap is facilitated for a user of the closure device.

In one embodiment of the closure device according to the invention, the outer surface of the entraining web has a first section and a second section following the first section in the circumferential direction, wherein the first section has a distance R1 from the closure cap axis, wherein the second section has a distance R2 from the closure cap axis, wherein R2 is not equal to R1, wherein preferably the distance R2 is greater than the distance R1, wherein particularly preferably the distance R2 is greater than the distance R1 by at least 0.2 mm and at most 3 mm.

In one embodiment of the closure device according to the invention, the outer surface of the entraining web extends axially substantially parallel to the closure cap axis.

In one embodiment of the closure device according to the invention, the first entraining web has an abutment edge, wherein the cutting device has an abutment element, wherein the first entraining web and the cutting device are configured and arranged in such a way, that when the closure cap is first rotated in the opening direction of rotation, the abutment edge of the first entraining web comes into engagement with the abutment element of the cutting device, so that a rotational movement of the cutting element is driven by the opening rotational movement of the closure cap, the first section of the first entraining web being arranged closer to the front edge than the second section when viewed in the circumferential direction.

The problem on which the invention is based is also solved by a closure element, wherein the closure element comprises a closure cap, wherein the closure cap has a cap cover and a cap skirt, wherein the cap skirt adjoins the cap cover circumferentially side and extends axially, wherein the closure element comprises an anchor ring and a connecting element, wherein the connecting element connects the anchor ring to the closure cap in a tension-proof manner, wherein the anchor ring is engageable with a basic member of a container having a pouring channel, wherein the connecting element has a connecting web extending between a first end portion and a second end portion, wherein the first end portion of the connecting web is connected to the anchor ring, wherein the second end portion of the connecting web is connected to the anchor ring, wherein the connecting element comprises a hinge element in addition to the connecting web, wherein the hinge element connects the connecting web to the cap skirt and is arranged between the connecting web and the cap skirt, wherein the hinge element defines a pivot axis, wherein the hinge element is configured such that the closure cap is pivotably mounted relative to the connecting web about the pivot axis, wherein the hinge element is configured and arranged such that the pivot axis is arranged on the side of the connecting web facing away from the inlet opening.

In one embodiment of the closure element according to the invention, the closure element is configured in such a way that the connecting web is axially movable at least in sections relative to the anchor ring, at least when the closure cap and the anchor ring are not or no longer connected to one another via easily non-tearable bridges.

In one embodiment of the closure element according to the invention, the connecting web and the hinge element are configured such that the connecting web has essentially no torsion when the closure cap is pivoted relative to the anchor ring.

The present invention also relates to a closure device for a container, in particular for a carton package, wherein the closure device comprises a basic member, wherein the basic member has a pouring channel extending along a closure axis with an inlet opening and a pouring opening, wherein the closure device comprises a closure cap, wherein the closure cap has a cap cover and a cap skirt, wherein the cap skirt adjoins the cap cover circumferentially and extends axially. The closure cap and the basic member are configured in such a way that the closure cap closes the pouring opening in a closed position of the closure cap and releases it in an open position of the closure cap, wherein the closure device comprises an anchor ring and a connecting element, wherein the connecting element connects the anchor ring to the closure cap in a tension-proof manner, wherein the anchor ring is in engagement with the basic member both in the closed position of the closure cap and in the open position of the closure cap in such a way that the closure cap is also tethered to the basic member with the connecting element and the anchor ring in the open position of the closure cap, wherein the connecting element has a connecting web extending between a first end section and a second end section, wherein the first end section of the connecting web is connected to the anchor ring, wherein the second end section of the connecting web is connected to the anchor ring, wherein the closure device is configured in such a way that the connecting web is axially movable relative to the anchor ring, wherein the closure cap has a first guiding means, wherein the basic member has a second guiding means, wherein the first guiding means and the second guiding means are disengageable to open the closure device, wherein the first guiding means and the second guiding means are engageable to close the closure device, wherein the first and the second guiding means are configured in such a way that an opening rotational movement of the closure cap in the circumferential direction relative to the basic member is necessary for disengagement of the first and second guiding means, wherein the connecting element has a guide element, wherein the guide element can be brought into engagement with the second guiding means in such a way that the opening rotational movement of the closure cap causes a movement of the connecting web relative to the anchor ring with an axial movement component in the direction of the pouring opening. The additional guide element of the connecting element simplifies the handling of the closure device during the opening and closing movement. In an embodiment relating to this, the first guiding means comprises an internal thread, wherein the second guiding means comprises an external thread, wherein the guide element comprises an internal thread segment. The latter is very suitable for locking the connecting element relative to the basic member when the closure cap is in the open position. According to a further embodiment, the guide element is arranged on an inner surface of the connecting web directed towards the closure axis when the closure cap is in the closed position. Further features of all embodiments described above can also be combined with the aspect of the invention described in this paragraph, in particular those features that do not relate to an additional hinge element.

BRIEF DESCRIPTION OF THE DRAWINGS

Further advantages, features and embodiments of the present invention will become apparent from the figures described below. It shows.

DETAILED DESCRIPTION OF THE INVENTION

Figure 1:
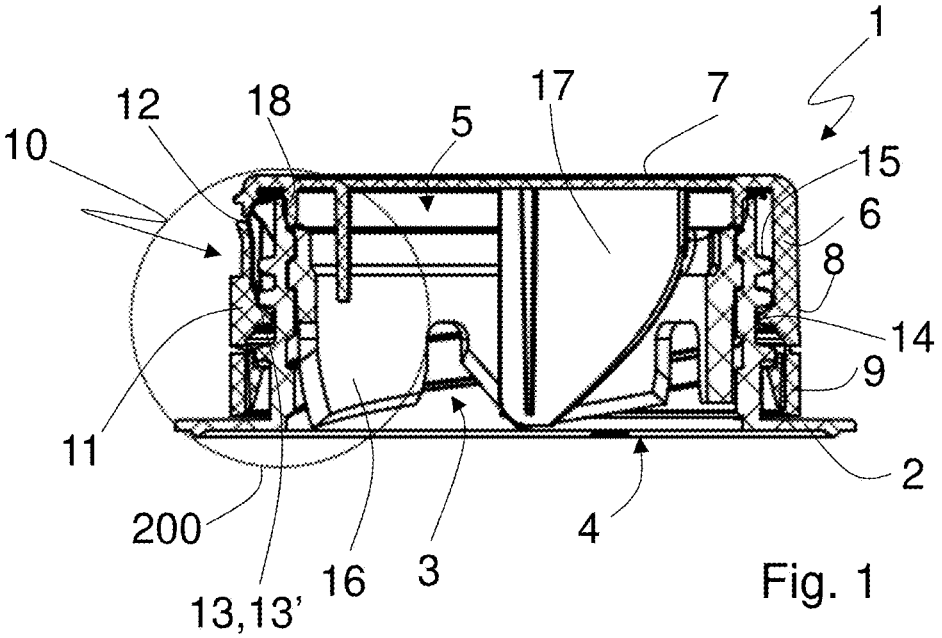
FIG. 1: a sectional view of a first embodiment of the closure device according to the invention, with the closure cap in the closed position.

The closure device 1 shown in FIGS. 1 to 4 is an aseptic closure device which is used in particular for closing carton packages. The carton package is completely sealed before the closure device 1 is opened for the first time.

The closure cap 6 is rotatably mounted relative to the basic member 2 of the closure device 1 via an internal thread arranged on the closure cap 6 and an external thread arranged on the basic member 2. A cutting device 16 with a cutting element is arranged inside the pouring channel 3. In addition, the closure device 1 has at least one entraining web 17 arranged on the cap cover 7. When the opening rotational movement of the closure cap 6 is executed for the first time in an opening rotational direction, the entraining web 17 comes into engagement with an abutment surface of the cutting device 16 and thus causes a rotational and at the same time axial movement of the cutting device 16. The cutting element moves in the axial direction through the inlet opening 4 and thus cuts an opening in the carton package when the closure device 1 is placed on a carton package. The filling material of the carton package can then pass through this opening from the carton package and be poured through the pouring channel 3 of the closure device 1 and thus be provided.

The embodiment of a closure device 1 according to the invention shown in FIGS. 1 to 4 also has a tethered closure cap 6. For this purpose, the closure device 1 has an anchor ring 9, which in the embodiment shown here is configured as a flex band with a radially outer section and a folded-over radially inner section. The radially inner section is in engagement with the pilfer-proof ring of the basic member 2 when the closure cap 6 together with the anchor ring 9 is placed on the basic member 2.

The combination of closure cap 6, connecting element 10 and anchor ring 9 is also referred to as closure element 100 for the purposes of the present invention.

The connecting element 10 of the embodiment shown in FIGS. 1 to 4 comprises a connecting web 11 extending in the circumferential direction, which is separated from the anchor ring 9 in the axial direction by a gap 19 or a weakening line. In the circumferential direction, the end sections of the connecting web 11 are connected to the anchor ring 9.

Figure 2:
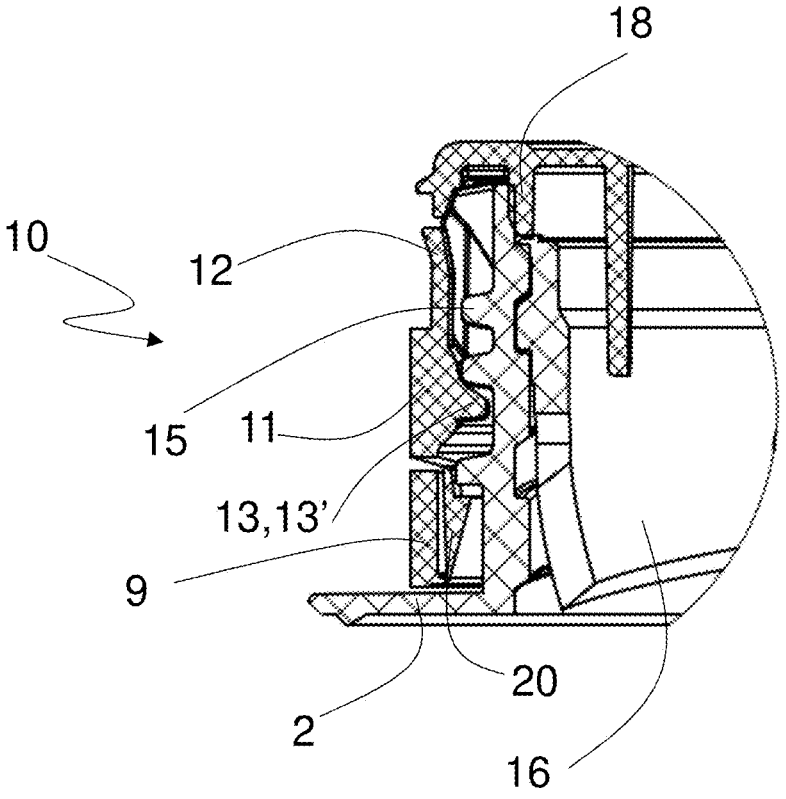
FIG. 2: an enlarged view of the connecting element of the closure devices of FIG. 1, FIG. 3: the closure device shown in FIG. 1, with the closure cap in an intermediate position between the closed position and the open position.

The area 200 marked in FIG. 1, which primarily shows the connecting element 10, is shown again enlarged in FIG. 2. The area 201 marked in FIG. 3 is shown enlarged again in FIG. 4.

Figure 3:
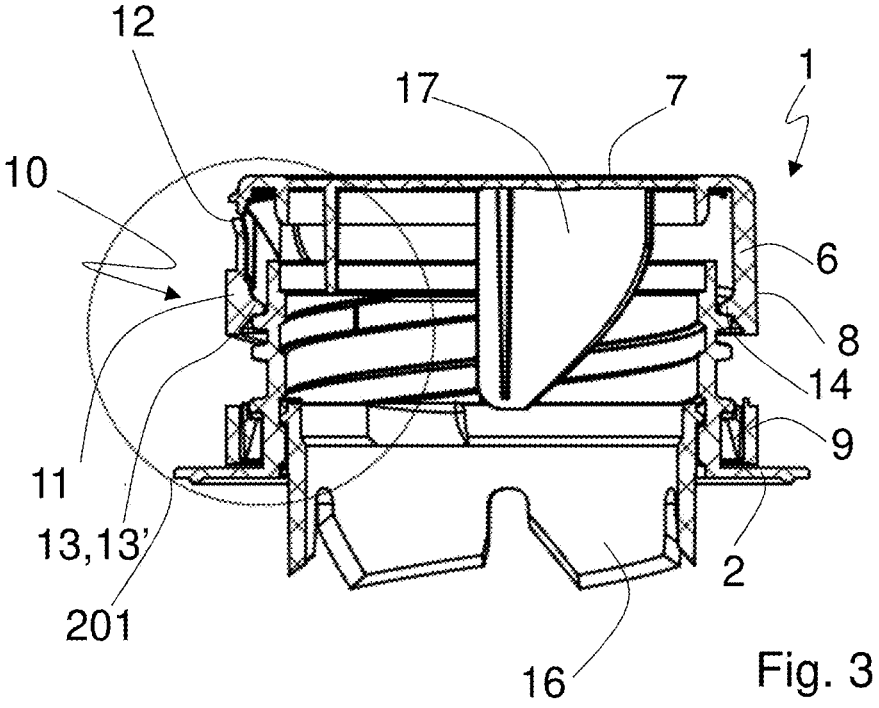
Figure 4:
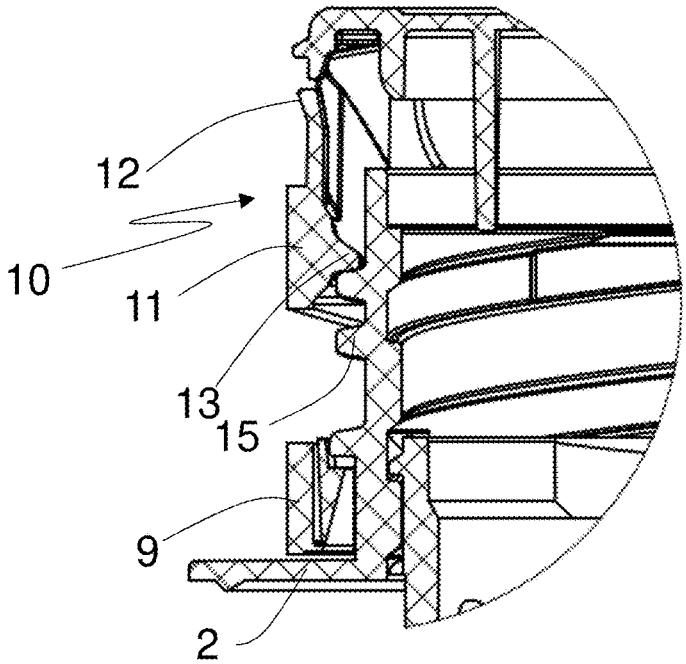
FIG. 4: an enlarged view of the connecting element of the closure device shown in FIG. 3, FIG. 5: a sectional view of a first embodiment of a closure element according to the invention.

When the closure device 1 is opened by an opening rotational movement and the closure cap 6 thus lifts off axially from the basic member 2, the connecting web 11 consequently also lifts off axially from the anchor ring 9. FIG. 3 shows the position of the closure cap 6 at which the connecting web 11 has lifted off the anchor ring 9 as far as possible. In order to move the closure cap 6 from this position to the open position, the closure cap 6 is pivoted about the pivot axis defined by the hinge element 12. The hinge element 12 is an additional hinge element 12, which is arranged above the connecting web 11.

If the closure cap 6 is now pivoted into the open position via the hinge element 12, the connecting web 11 retains its position relative to the basic member 2. In particular, there is no torsion of the connecting web 11. This contributes to the closure cap 6 having a higher resilience to operating errors in everyday use. This is because, despite the connection of the closure cap 6 via a connecting web 11 extending in the circumferential direction, the closure cap 6 cannot be moved in a transverse direction relative to the closure axis in the open position, or only to a very small extent. However, such movements in transverse directions are sometimes made unintentionally by the user, which makes it more difficult to reclose the closure cap 6.

In order to further strengthen the strength of the locking of the connecting web 11 relative to the basic member 2, the connecting element 10 has a support means which is arranged on the inside of the connecting web 11 and rests on a support surface of the basic member 2, at least when the closure cap 6 is in the open position. In the embodiments shown in FIGS. 1 to 4, the support means already rests on the external thread of the basic member 2 when the closure cap 6 is in the intermediate position shown in FIG. 3, i.e. when the opening rotational movement has already been fully executed but no opening pivoting movement has yet been executed.

The support means can be an internal thread segment that only extends over a fraction of the full circumferential angle of 360° in the circumferential direction. As in the embodiments shown in FIGS. 1 to 4, this internal thread segment can also be used simultaneously as a guiding means 14, so that the internal thread segment together with a further internal thread segment forms the internal thread for rotatably opening or closing the closure device 1.

Figure 10:
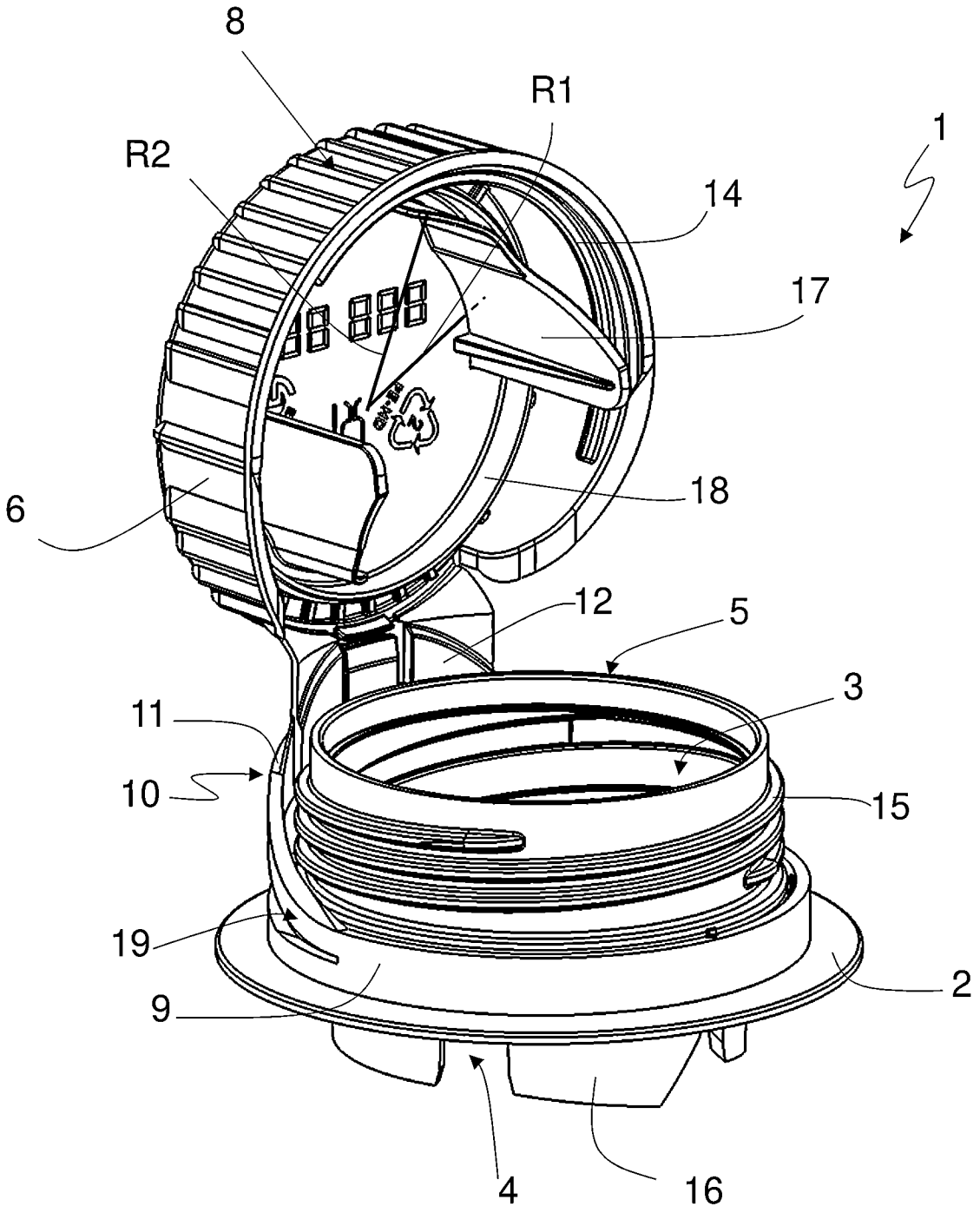

FIG. 10 shows the closure device 1 in a perspective view. In particular, the first guiding means 14 configured as an internal thread segment and the second guiding means 15 configured as an external thread are clearly recognisable. It can also be seen that the connecting web 11 lifts off the anchor ring 9 in the open position shown and is locked in this position. The support element 13 used here is concealed due to the perspective and is therefore not visible.

The two entraining webs 17 recognisable in FIG. 10 and arranged on the cap cover 7 also have outer surfaces, each of which has a ramp section arranged between a first section and a second section of the outer surface. The first section is arranged closer to the closure cap axis than the second section. This design is particularly advantageous for the entraining web 17 that is arranged closest to the hinge element 12. The ramp section of this entraining web 17 comes into contact with the spout edge section 22 of the basic member 2 during a closure pivoting movement, whereby the closure cap 6 is subject to a leverage effect and the closure process is made easier for a user. The further entraining web 17 is configured in the same way, as this makes it advantageous to manufacture the closure device 1 by injection moulding. This is because making the closure device 1 as symmetrical as possible goes hand in hand with filling the associated mould as evenly as possible.

Figure 5:
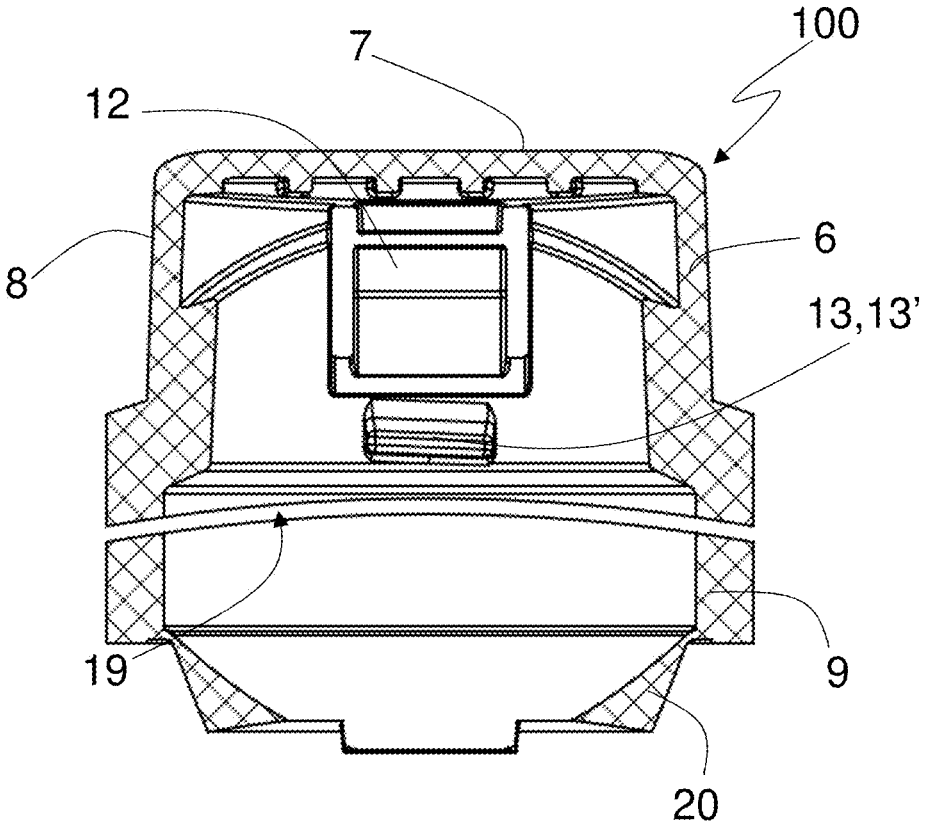

FIG. 5 shows an embodiment of a closure element 100, which is the closure element 100 used in the embodiment of a closure device 1 shown in FIGS. 1 to 4. FIG. 5 once again clearly shows the design of the support means. This is formed as an internal thread segment with a pitch corresponding to the pitch of the external thread of the basic member 2 shown in FIGS. 1 to 4.

The further FIGS. 6A to 9B show further embodiments of closure elements 100 which, in conjunction with correspondingly configured basic members 2, can also form corresponding embodiments of closure devices 1 according to the invention. The four different embodiments of closure elements 100 shown in these figures differ mainly in that the support means are configured differently in each case and the hinge elements 12 also differ.

Figure 6A:
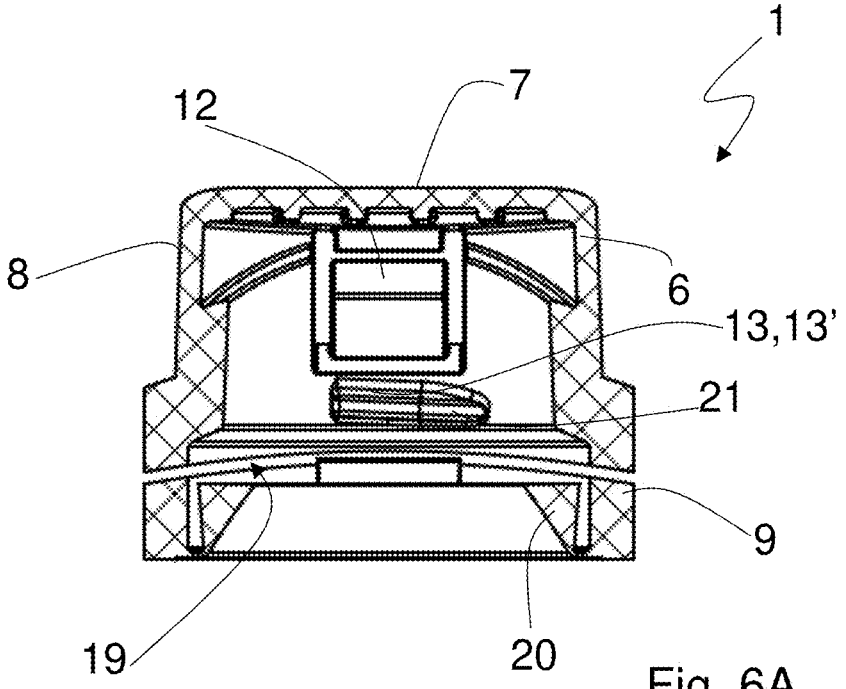
FIG. 6A: a second embodiment of a closure element according to the invention in a sectional view.
Figure 6B:
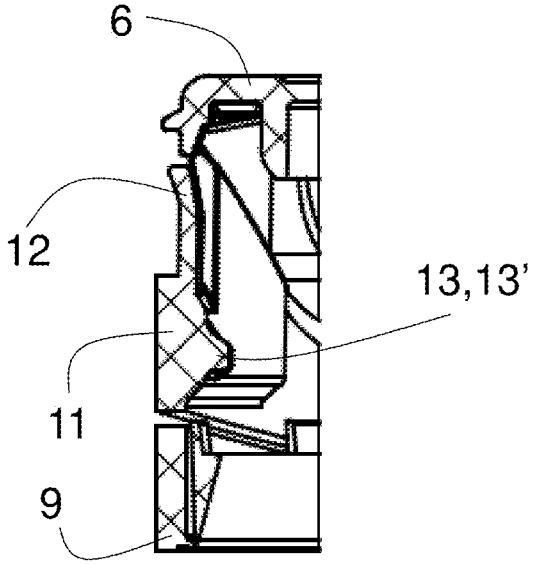
FIG. 6B: an enlarged view of the connecting element of the closure element of FIG. 6A, FIG. 7A: a third embodiment of a closure element according to the invention in a sectional view.

In the embodiment shown in FIGS. 6A and 6B, the support means differs from the embodiment shown in FIG. 5 in that the support means according to FIG. 6A or 6B has a thread run-out 21. This thread run-out 21 is characterised by the fact that the axial extension of the threaded segment is reduced in the area of the thread run-out 21 when viewed in the circumferential direction. In other words, the internal thread segment tapers in the circumferential direction.

Figure 7A:
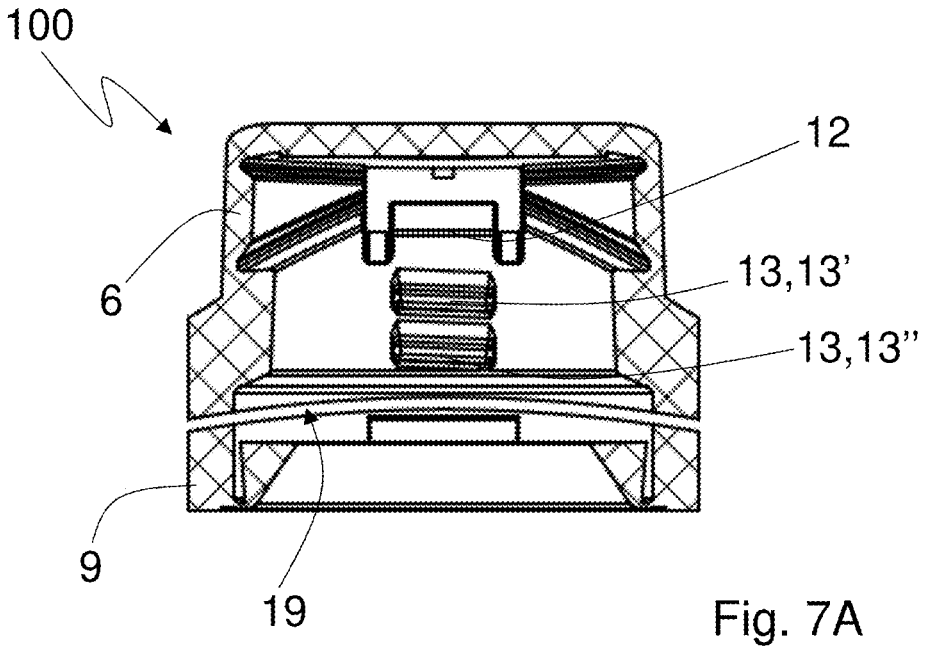
FIG. 7B: an enlarged view of the connecting element of the closure element of FIG. 7A, FIG. 8A: a fourth embodiment of a closure element according to the invention in a sectional view.
Figure 7B:
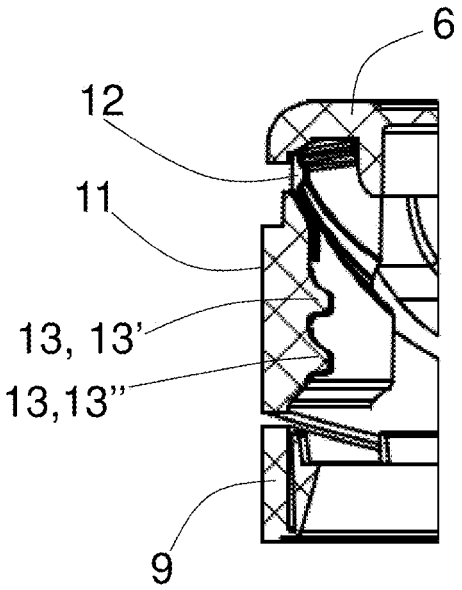

In the embodiment of a closure element 100 shown in FIGS. 7A and 7B, the connecting element 10 has two axially spaced-apart internal thread segments 13' and 13", which form the support element 13. These internal thread segments 13' and 13" grip around a correspondingly configured support element of the basic member 2 like a pair of pliers (not shown) when the closure cap 6 is in the open position and thus lock the connecting web 11 with respect to the basic member 2 even more firmly.

Figure 8A:
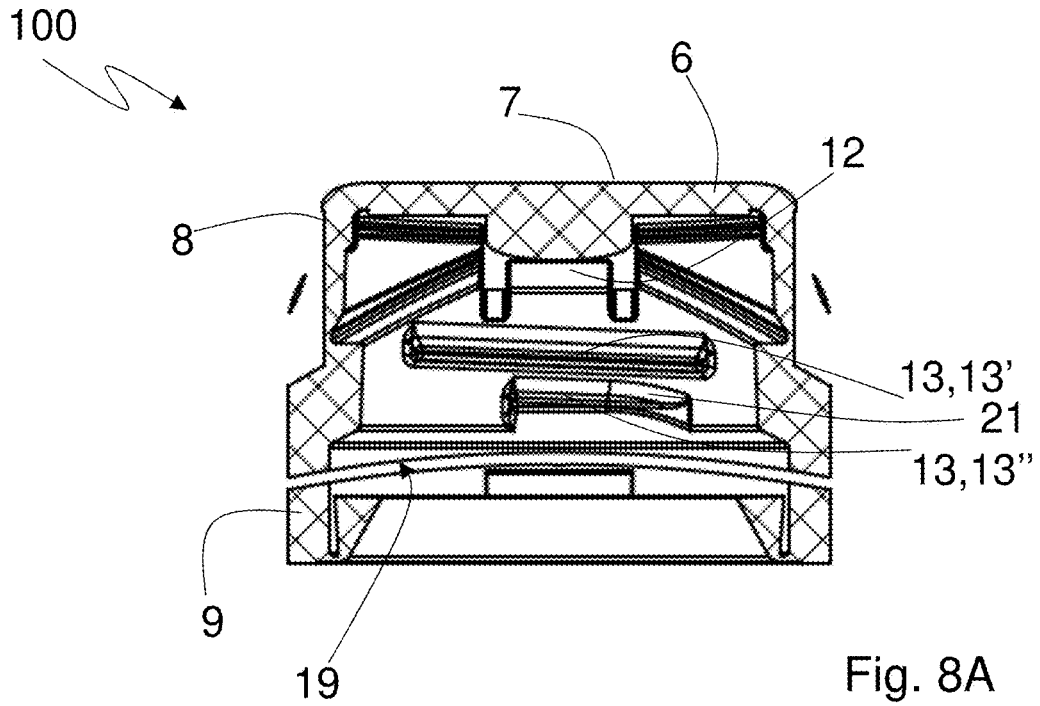
FIG. 8B: an enlarged view of the connecting element of the closure element of FIG. 8A, FIG. 9A a fifth embodiment of a closure element according to the invention in a sectional view.
Figure 8B:
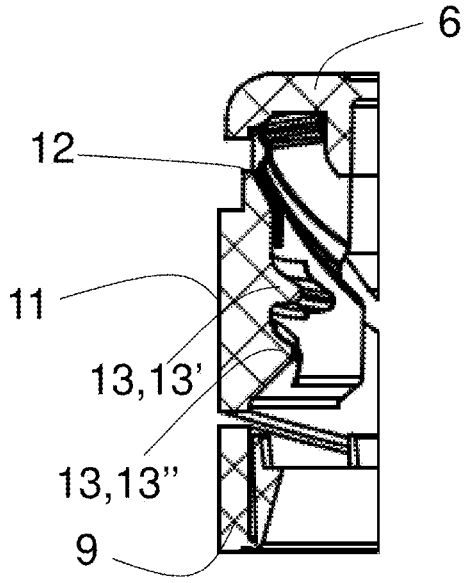

In the embodiment shown in FIGS. 8A and 8B, these two internal thread segments 13', 13" are each significantly longer in the circumferential direction, with the upper internal thread segment 13' being configured longer than the lower internal thread segment 13" and the lower internal thread segment 13" having a thread run-out 21.

Figure 9A:
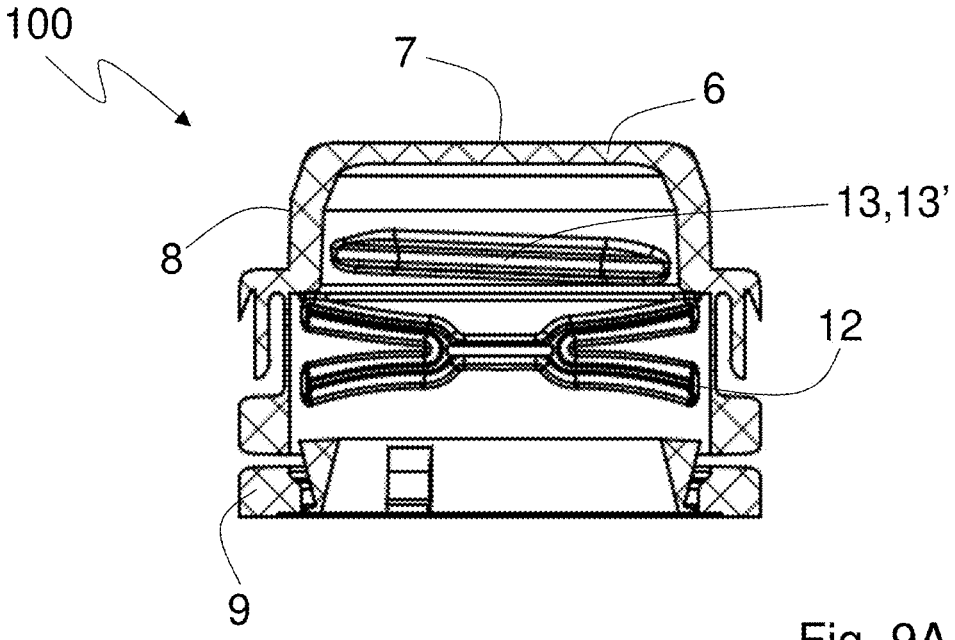
FIG. 9B: an enlarged view of the connecting element of the closure element from FIG. 9A, FIG. 10: a perspective view of the first embodiment of the closure device according to the invention.
Figure 9B:
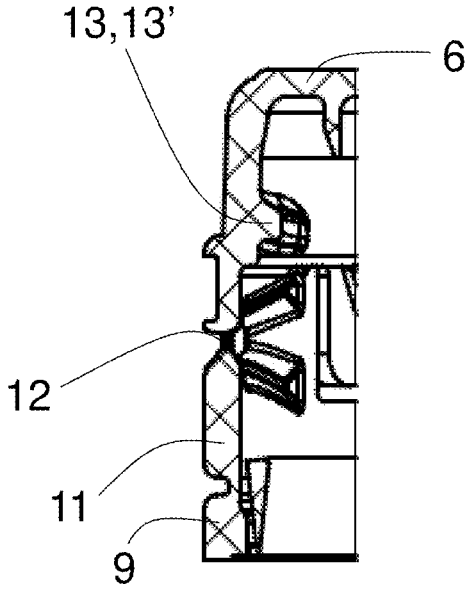

In the embodiment shown in FIGS. 9A and 9B, the support means 13 is arranged above the hinge element 12. In other words, in a correspondingly configured closure device 1 comprising the closure element 100 shown here, the hinge element 12 is arranged closer to the inlet opening 4 than the support means 13. In this embodiment, the hinge element 12 comprises an X-shaped thin-walled region through which a film hinge is provided.

LIST OF REFERENCE SIGNS

1 Closure device
2 Basic member
3 Pouring channel
4 Inlet opening
5 Pouring opening
6 Closure cap
7 Cap cover
8 Cap skirt
9 Anchor ring
10 Connecting element
11 Connecting web
12 Hinge element
13 Support element/guide element
13' (upper) internal thread segment
13' (lower) internal thread segment
14 First guiding means
15 Second guiding means
16 Cutting device
17 Entraining web(s)
18 Sealing olive
19 Gap
20 Inner section of the flex band
21 Thread run-out
22 Spout edge section
100 Closure element

The invention claimed is:

1. A closure device (1) for a container, in particular for a carton package, comprising:

a basic member (2), including a pouring channel (3) extending along a closure axis and having an inlet opening (4) and a pouring opening (5);

a closure cap (6), including a cap cover (7) and a cap skirt (8) adjoining the cap cover (7) circumferentially and extending axially;

the closure cap (6) and the basic member (2) being configured such that the closure cap (6) closes the pouring opening (5) in a closed position of the closure cap (6) and releases it in an open position of the closure cap (6);

the closure device (1) further comprising an anchor ring (9) and a connecting element (10) that connects the anchor ring (9) to the closure cap (6) in a tension-proof manner, the anchor ring (9) engaging the basic member (2) both in the closed position of the closure cap (6) and in the open position of the closure cap (6) such that the closure cap (6) is tethered to the basic member (2) with the connecting element (10) and the anchor ring (9) in the open position of the closure cap;

the connecting element (10) including a connecting web (11) extending between a first end portion and a second end portion, the first end portion being connected to the anchor ring (9), the second end portion being connected to the anchor ring (9), the connecting web (11) being axially movable relative to the anchor ring (9);

the connecting element (10) including a hinge element (12) that connects the connecting web (11) to the cap skirt (8) and is arranged between the connecting web (11) and the cap skirt (8);

the hinge element (12) defining a pivot axis and being configured such that the closure cap (6) is pivotably mounted relative to the connecting web (11) about the pivot axis; and wherein the connecting element (10) further comprises a support element (13) positioned on the connecting web (11) and configured and arranged to engage an outer surface of the basic member (2) and lock the connecting web (11) when the closure cap (6) performs an opening pivoting movement about the pivot axis in order to bring the closure cap (6) into the open position.

2. The closure device according to claim 1, wherein the hinge element (12) is configured such that the pivot axis is positioned at an axial distance from the connecting web (11).

3. The closure device according to claim 1, wherein the connecting web (11) and the hinge element (12) are configured such that the connecting web (11) has essentially no torsion when the cap (6) is in the open position.

4. The closure device (1) according to claim 1, wherein:

the closure cap (6) further comprises a first guiding means (14), the basic member (2) further comprises a second guiding means (15), the first guiding means (14) and the second guiding means (15) disengage one another to open the closure device (1), the first guiding means (14) and the second guiding means (15) can engage one another to close the closure device (1), and the first and second guiding means (14, 15) are configured such that a rotational opening movement of the closure cap (6) relative to the basic member (2) is required to disengage the first and second guiding means (14, 15) from each other.

5. The closure device (1) according to claim 4, wherein the support element (13) is configured to engage the second guiding means (15) such that the rotational opening movement of the closure cap (6) causes a movement of the connecting web (11) relative to the anchor ring (9), the movement having an axial movement component in a direction of the pouring opening (5).

6. The closure device (1) according to claim 5, wherein:

the first guiding means (14) comprises an internal thread, the second guiding means (15) comprises an external thread, and the support element (13) comprises an internal thread segment (13').

7. The closure device (1) according to claim 5, wherein the support element (13) is positioned on an inner surface of the connecting web (11), and the inner surface is directed towards the closure axis when the closure cap (6) is in the closed position.

8. The closure device (1) according to claim 5, wherein the support element (13) and the hinge element (12) are configured and arranged such that a first distance between the support element (13) and the inlet opening (4) is less than a second distance between the pivot axis and the inlet opening (4).

9. The closure device (1) according to claim 5, wherein the support element (13) comprises two axially offset internal thread segments (13', 13").

10. The closure device (1) according to claim 9, wherein a first of the two axially offset internal thread segments has a first profile depth (x), a second of the two axially offset internal thread segments has a second profile depth (y), and the first profile depth (x) is equal or greater than the second profile depth (y).

11. The closure device (1) according to claim 10, wherein sections of the two axially offset internal thread segments (13', 13") are arranged axially one above the other.

12. The closure device (1) according to claim 6, wherein the external thread of the basic member (2) has a thread pitch (a), the internal thread segment (13') of the support element (13) has a thread pitch (b), and the thread pitch (a) and the thread pitch (b) are substantially the same.

13. The closure device (1) according to claim 1, further comprising:

a cutting device (16) with a cutting element arranged at least in sections within the pouring channel (3);

wherein the closure cap (6) further includes at least a first entraining web with an inner surface directed towards the closure axis and an outer surface directed away from the closure axis;

the first entraining web and the cutting device (16) are configured such that an initial rotation of the closure cap (6) in an opening rotation direction causes a movement of the cutting element from an initial position in a direction pointing from the pouring opening (5) to the inlet opening (4), so that the cutting element can be moved at least in sections through the inlet opening (4); and the closure axis is an axis of rotation of the opening direction.

14. A closure element (100), comprising:

a basic member (2);

a closure cap (6) including a cap cover (7) and a cap skirt (8) adjoining the cap cover (7) circumferentially and extending axially;

an anchor ring (9) engageable with a base element (2) of a container having a pouring channel;

and a connecting element (10) for connecting the anchor ring (9) to the closure cap (6) in a tension-proof manner and having a connecting web extending between a first end portion and a second end portion;

wherein the first end portion of the connecting web (11) is connected to the anchor ring (9), the second end portion of the connecting web (11) is connected to the anchor ring (9), and at least one of the connecting element (10) and the connecting web (11) includes a hinge element (12);

the hinge element (12) connects the connecting web (11) to the cap skirt (8) and is arranged between the connecting web (11) and the cap skirt (8), defines a pivot axis, and is configured and arranged such that the closure cap (6) is pivotably mounted relative to the connecting web (11) about the pivot axis, and the pivot axis is arranged on a side of the connecting web (11) facing away from an inlet opening (4); and wherein the connecting element (10) further comprises a support element (13) positioned on the connecting web (11) and configured and arranged to engage an outer surface of the basic member (2) and lock the connecting web (11) when the closure cap (6) performs an opening pivoting movement about the pivot axis in order to bring the closure cap (6) into an open position.

15. A closure device (1) for a container, in particular for a carton package, comprising:

a basic member (2) including a pouring channel (3) extending along a closure axis and having an inlet opening (4) and a pouring opening (5);

a closure cap (6) including a cap cover (7) and a cap skirt (8) adjoining the cap cover (7) circumferentially and extending axially;

the closure cap (6) and the basic member (2) being configured such that the closure cap (6) closes the pouring opening (5) in a closed position of the closure cap (6) and releases it in an open position of the closure cap (6);

the closure device (1) further comprising an anchor ring (9) and a connecting element (10) that connects the anchor ring (9) to the closure cap (6) in a tension-proof manner, the anchor ring (9) engaging the basic member (2) both in the closed position of the closure cap (6) and in the open position of the closure cap (6) such that the closure cap (6) is tethered to the basic member (2) with the connecting element (10) and the anchor ring (9) in the open position of the closure cap;

the connecting element (10) including a connecting web (11) extending between a first end portion and a second end portion, the first end portion being connected to connected to the anchor ring (9), the second end portion being connected to the anchor ring (9), the connecting web (11) being axially movable relative to the anchor ring (9);

the closure cap (6) further including a first guiding means (14); and the basic member (2) further including a second guiding means (15);

wherein the first guiding means (14) and the second guiding means (15) can be disengaged to open the closure device (1), and can be brought into engagement to close the closure device (1);

the first and second guiding means (14, 15) are configured such that an opening rotational movement of the closure cap (6) relative to the basic member (2) causes disengagement of the first and second guiding means (14, 15); and the connecting element (10) includes a support element (13) positioned on the connecting web 11 that can engage the second guiding means (15) such that the opening rotational movement of the closure cap (6) causes a movement of the connecting web (11) relative to the anchor ring (9) with an axial movement component in a direction of the pouring opening (5);

wherein the support element (13) is configured and arranged to engage an outer surface of the basic member (2) and lock the connecting web (11) when the closure cap (6) performs an opening pivoting movement about the pivot axis in order to bring the closure cap (6) into the open position.

16. The closure device according to claim 15, wherein:

the first guiding means (14) includes an internal thread, the second guiding means (15) includes an external thread, and the support element (13) includes an internal thread segment (13').

17. Closure device according to claim 16, wherein the support element (13) is positioned on an inner surface of the connecting web (11), and the inner surface is directed towards the closure axis when the closure cap (6) is in the closed position.

* * * * *